US005546777A

United States Patent [19]

Liu et al.

[11] Patent Number: 5,546,777

[45] Date of Patent: Aug. 20, 1996

[54] REMOTE-CONTROLLED LOCK DEVICE FOR MOTOR VEHICLES

[76] Inventors: Chao-Ming Liu, No. 82, Lin 4, Mao Shang Tsun, Wu Ku Hsiang, Taipei Hsien; Chih-Lung Lin, No. 289, Yueh Mei Tan, Yueh Tan Tsun, Hsing Kang Hsiang, Chia I Hsien, both of Taiwan

[21] Appl. No.: 449,547

[22] Filed: May 24, 1995

[51] Int. Cl.[6] ..... E05B 47/00

[52] U.S. Cl. ..... 70/257; 70/280; 70/461; 292/144; 292/DIG. 60

[58] Field of Search ..... 70/256, 257, 461, 70/277–282; 292/144, 176, DIG. 60; 180/287

[56] References Cited

U.S. PATENT DOCUMENTS

| | | | |
|---|---|---|---|
| 2,242,707 | 5/1941 | Haynes | 292/144 |
| 2,271,966 | 2/1942 | Baribault | 292/144 X |
| 2,785,916 | 3/1957 | Mutti | 292/144 |
| 3,425,742 | 2/1969 | Rauber, Jr. | 292/144 X |
| 3,543,546 | 12/1970 | Gallo | 292/144 X |
| 3,767,240 | 10/1973 | Belanger | 292/144 |
| 3,829,834 | 8/1974 | Frankland et al. | 292/144 X |
| 5,263,347 | 11/1993 | Allbaugh et al. | 70/280 X |

FOREIGN PATENT DOCUMENTS

| | | | |
|---|---|---|---|
| 2480841 | 10/1981 | France | 70/280 |
| 2240808 | 8/1991 | United Kingdom | 70/277 |

*Primary Examiner*—Lloyd A. Gall
*Attorney, Agent, or Firm*—Varndell Legal Group

[57] ABSTRACT

A remote-controlled lock device including a striking plate fixed to one door pillar (or the trunk) of the car, a mounting plate fixed to the corresponding door (or the trunk lid) of the car, a casing fixed to the mounting plate, a reversible motor, a transmission device coupled to the reversible motor, a lock bolt disposed in the mounting plate and moved by the transmission device between the locking position to lock the door (or the trunk lid) and the unlocking position to unlock the door (or the trunk lid), a two-way switch automatically triggererd to cut off power supply from the reversible motor when the lock bolt is moved to the locking or unlocking position, a remote controller, and a control circuit controlled by the remote controller to turn the reversible motor forwards or backwards.

3 Claims, 6 Drawing Sheets

REMOTE-CONTROLLED LOCK DEVICE FOR MOTOR VEHICLES

BACKGROUND AND SUMMARY OF THE INVENTION

The present invention relates to lock devices, and relates more particularly to a remote-controlled lock device installed in one door or the trunk of a motor vehicle and controlled by a remote control to lock the door or trunk.

A variety of mechanical lock devices and impact-detection type electronic car alarms have been developed for use with motor vehicles, and have appeared on the market. Regular lock devices for motor vehicles include steering wheel locks, car door locks, locks for trunk. Regular impact-detection type electronic car alarms can not completely eliminate tendency to be triggered by an error signal. When an impact-detection type electronic car alarm in triggered, it will produce a high noise. The common drawback of conventional mechanical lock devices for motor vehicles is that they are not invisible and can be destroyed or broken by cutting tools.

The present invention has been accomplished by an assembly connected between the transmission rod and the reversible motor for permitting the reversible motor to be installed in the car at a far place away from the casing.

DETAILED DESCRIPTION OF THE PREFERRED EMBODIMENT

Figure 2:
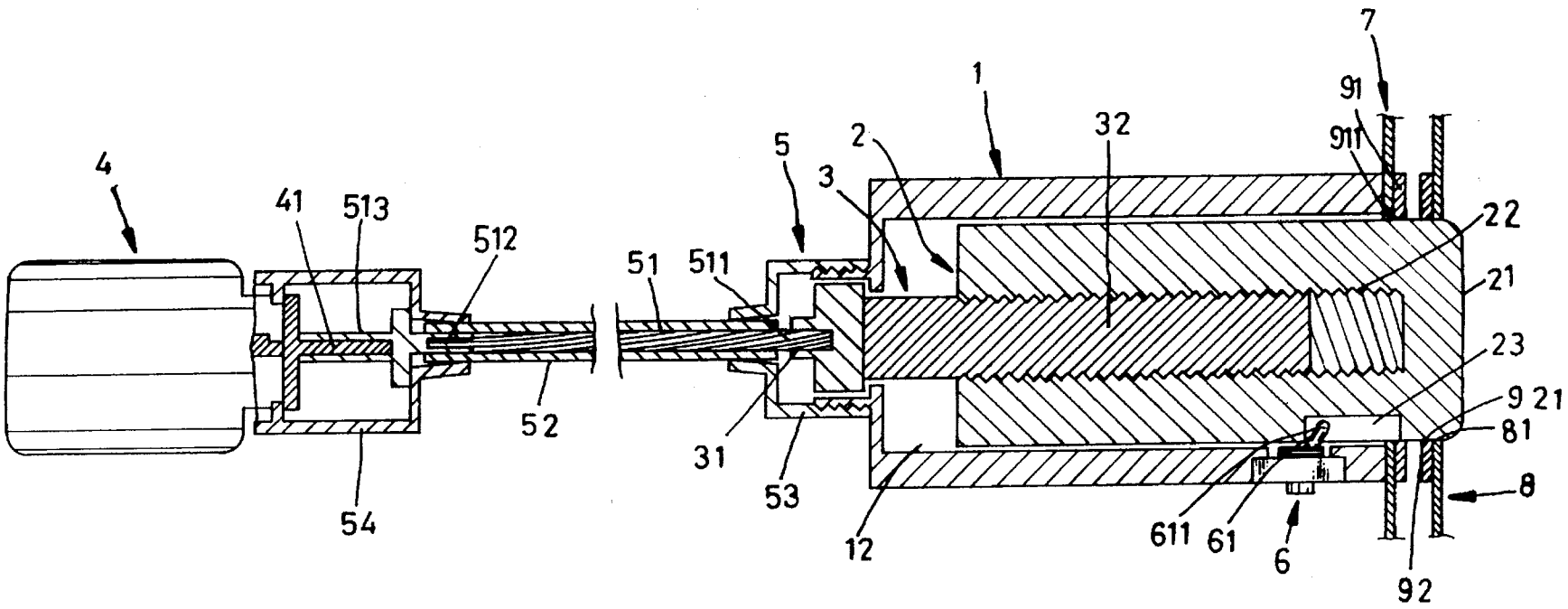
FIG. 2 is a longitudinal assembly view in section of the lock device shown in FIG. 1 when locked.

The lock device of the present invention is to be installed in the door 7 and the door pillar 8 and controlled by a remote controller to lock the door 7 (see FIG. 2). The lock device can also be installed in the trunk and the trunk lid and controlled by a remote controller to lock the trunk lid.

Referring to FIGS. from 1 to 7, the lock device is comprised of a remote controller (R), a control circuit (C), a casing 1, a locking bolt 2, a transmission rod 3, a reversible motor 4, a transmission wire assembly 5, a two-way switch 6, a mounting plate 91, and a striking plate 92.

The remote controller is controlled to give an operational signal to the reversible motor 4, causing the reversible motor 4 to turn forwards or backwards.

The control circuit has a power input terminal connected to the car battery power supply of the motor vehicle, and a receiver circuit for receiving the operational signal from the remote controller. Upon receipt of the operational signal from the remote controller, the control circuit drives the reversible motor 4 to turn forwards or backwards subject to the nature of the operational signal. The control circuit further comprises an automatic switching circuit, which automatically switches the power input terminal from the car battery power supply to a battery set when the car battery power supply fails. Therefore, the lock device can be operated normally when the car battery power supply is unable to work normally. An alarm circuit can also be used and connected to the control circuit to give an alarm signal when the lock device is unlocked by violence.

Figure 4:
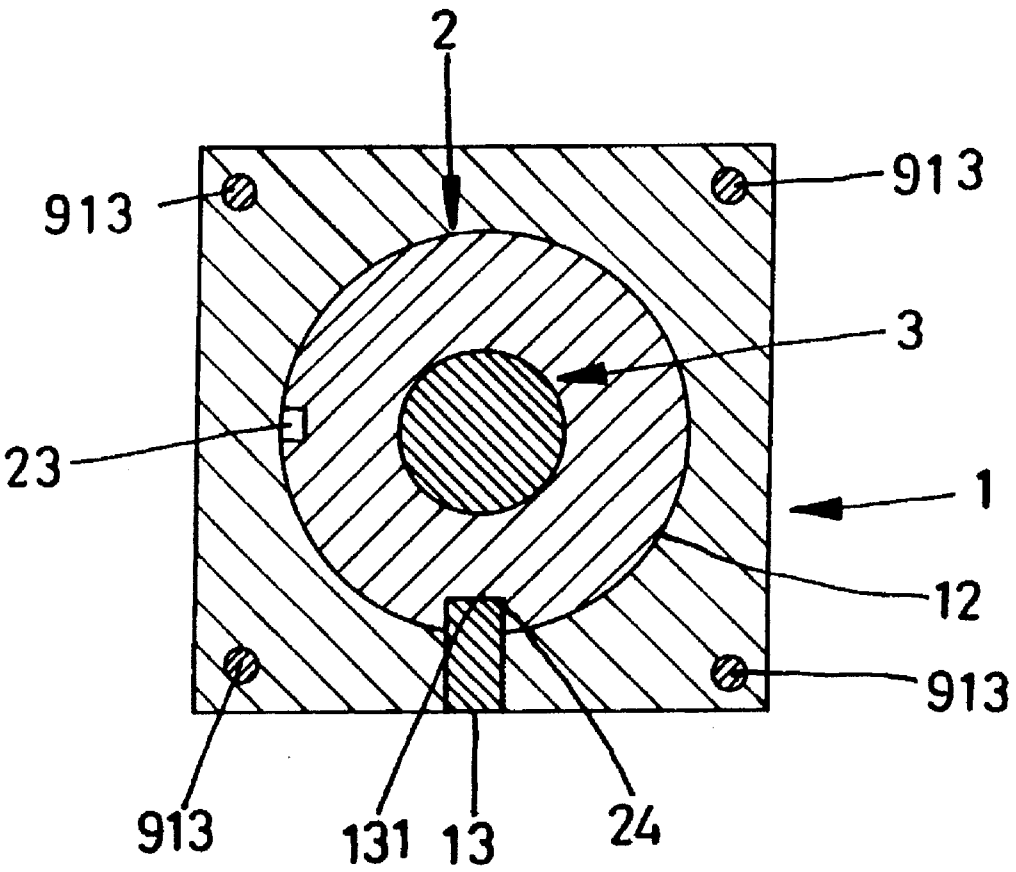
FIG. 4 is an end view in section of the lock device shown in FIG. 2.
Figure 6:
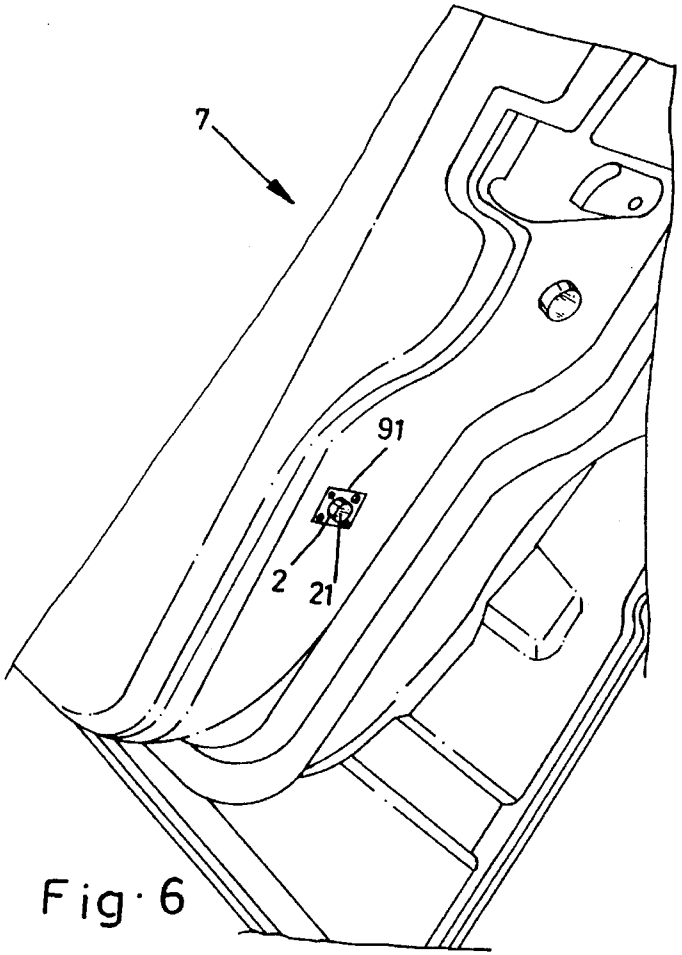
FIG. 6 is another installed view, showing the mounting plate fixed to the door according to the present invention.
Figure 5:
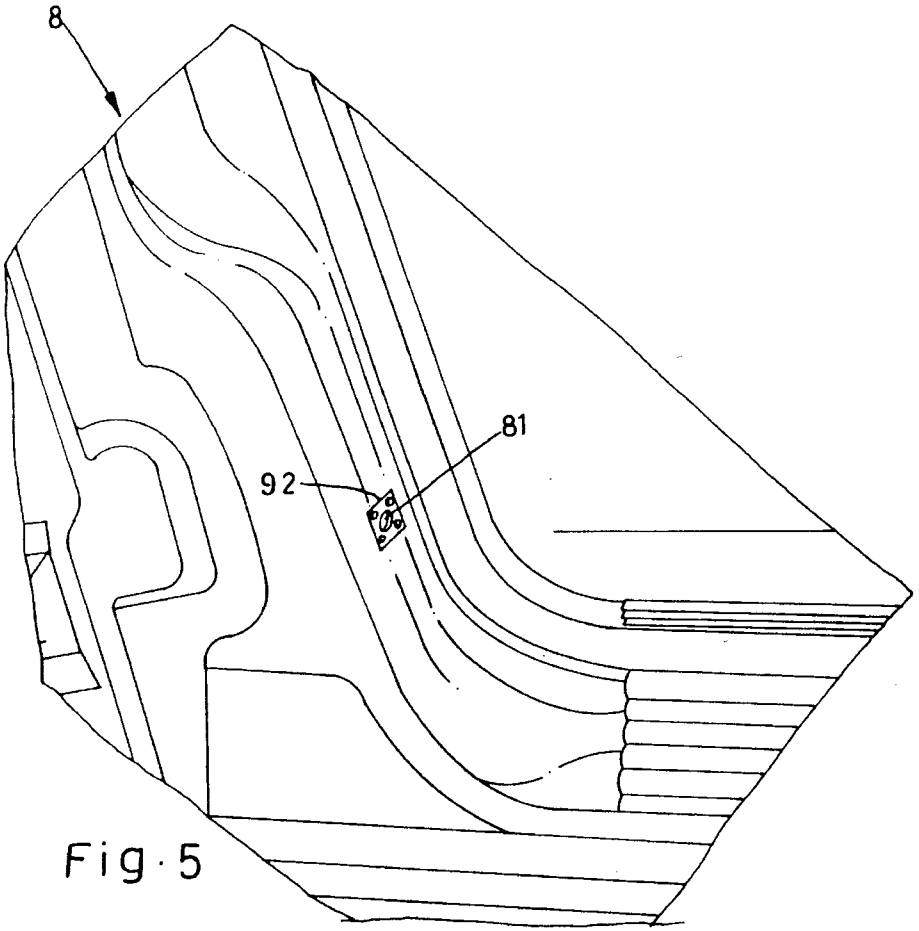
FIG. 5 is an installed view showing the striking plate fixed to the door pillar according to the present invention.

The casing 1 comprises a plurality of longitudinal screw holes 11 for connection to respective mounting holes (not shown) on the door 7, a longitudinal center hole 12, which receives the lock bolt 2 and the transmission rod 3, a locating pin at the bottom side, which has a top end 131 inserted into a longitudinal sliding slot 24 on the lock bolt 2 (see FIG. 4) for guiding the lock bolt 2 when the lock bolt 2 is moved by the transmission rod 3, a coupling tube 14 at one end, which has an outer thread 141 for mounting the transmission wire assembly 5, a side opening 15, which receives the two-way switch 6 for permitting the front end 511 of the control lever 61 to be inserted into a longitudinal locating slot 23 on the lock bolt 2.

Figure 3:
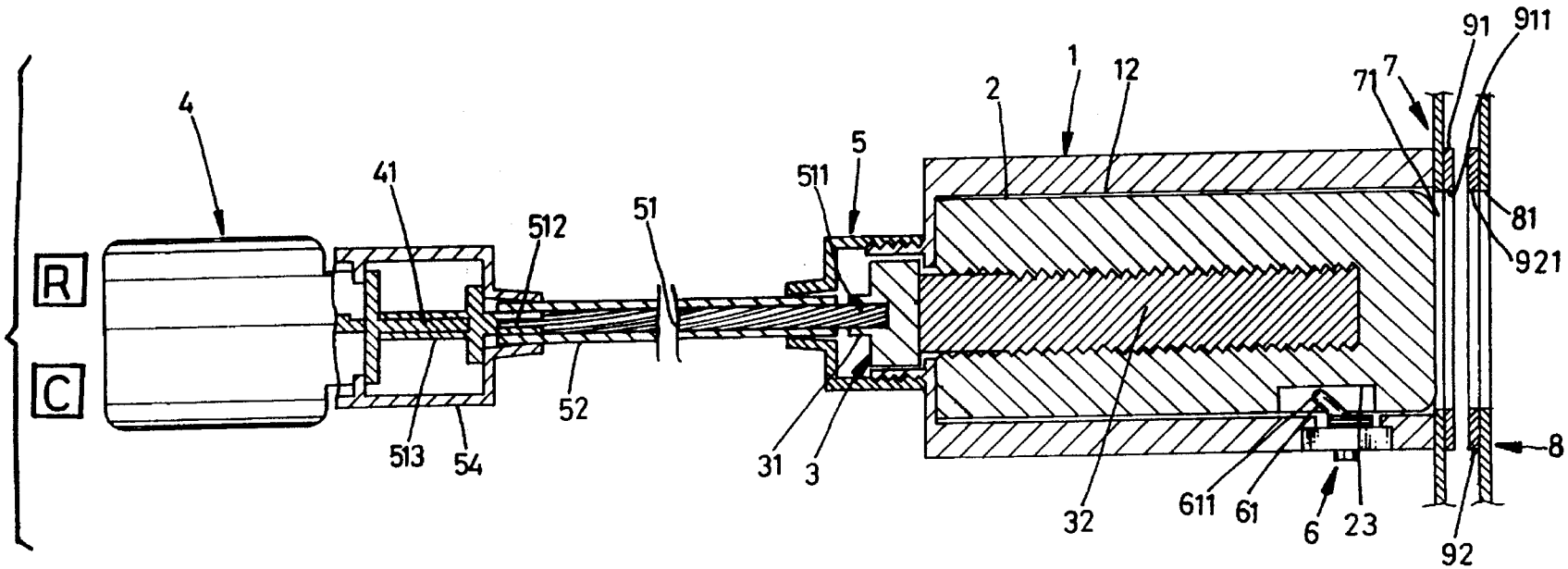
FIG. 3 is similar to FIG. 2 but showing the lock device unlocked.

The lock bolt 2 is moved in and out of the longitudinal center hole 12 o f the casing 1, comprising a longitudinal screw hole 22 at one end into which the screw rod section 32 of the transmission rod 3 is threaded (see FIGS. 2 and 3 a longitudinal locating slot 23 coupled to the control lever 61 of the two-way switch 6, and a longitudinal sliding slot 24, which receives the top end 131 of the locating pin 13.

The transmission rod 3 comprises an elongated screw rod section 32 at one end threaded into the longitudinal screw hole 22 on the lock bolt 2, and a coupling hole 31 at an opposite end coupled to the transmission wire 51 of the transmission wire assembly 5.

The transmission wire assembly 5 comprises a flexible tube 52, a first screw cap 53 fixedly connected to the flexible tube 52 at one end and threaded onto the outer threads 141 of the coupling tube 14 of the casing 1, a second screw cap 54 fixedly connected to the flexible tube 52 at an opposite end and fastened to the reversible motor 4, and a transmission wire 51 inserted through the flexible tube 52 and having one end 511 fitted into the coupling hole 31 of the transmission rod 3 and an opposite end 512 coupled to the output shaft 41 of the reversible motor 4 by a connector 513. The transmission wire assembly 5 permits the reversible motor 4 to be installed inside the motor vehicle at a distance from the casing 1.

The mounting plate 91 comprises a center hole 911 aligned with a hole 71 on the door 7, a plurality of screw holes 912 respectively connected to respective throuh holes (not shown) on the door 7 and the screw holes 11 on the casing 1 by respective screws 913. When the mounting plte 91 is installed, the front end 21 of the lock bolt 2 can be driven into the center hole 911 on the mounting plate 91 and the hole 71 on the door 7.

The striking plate 92 comprises a locating hole 921 aligned with a hole 81 on the door pillar 8 and the hole 71 on the door 7 and the longitudinal center hole 12 on the casing 1, a plurality of mounting holes 922 respectively connected to respective through holes (not shown) on the door pillar by rivets 923. When the lock bolt 2 is moved forwards, the front end 21 of the lock bolt 2 is forced into the center hole 911 on the mounting plate 91, the hole 71 on the door 7, the locking hole 921 on the striking plate 92, and the hole 81 on the door pillar 8 to lock the door 7.

When the reversible motor 4 is turned in one direction by means of the control of the remote controller, the transmission wire 51 is turned by the output shaft 41 of the reversible motor 4 to turn the transmission rod 3, causing the lock bolt 2 to be driven into the center hole 911 on the mounting plate 91, the hole 71 on the door 7, the locking hole 921 on the striking plate 92, and the hole 81 on the door pillar 8, and therefore the door 7 is locked. When the door 7 is locked, the control lever 61 of the two-way switch 6 is simultaneously forced to "OFF" position by the lock bolt 2 to cut off power supply from the reversible motor 4. Therefore, the door 7 is maintained in the locking position (see FIG. 2). When the reversible motor 4 is turned in the reversed direction by means of the control of the remote controller, the transmission wire 51 is turned by the output shaft 41 of the reversible motor 4 to turn the transmission rod 3, causing the lock bolt 2 to be moved from the hole 81 on the door pillar 8, the locking hole 921 on the striking plate 92, the hole 71 on the door 7, the center hole 911 on the mounting plate 91 back inside the casing 1 Lo unlock the door 7. When the door 7 is unlocked, the control lever 61 of the two-way switch 6 is simultaneously forced to "OFF" position by the lock bolt 2 to cut off power supply from the reversible motor 4. Therefore, the door 7 is maintained in the unlocking position (see FIG. 3).

Figure 1:
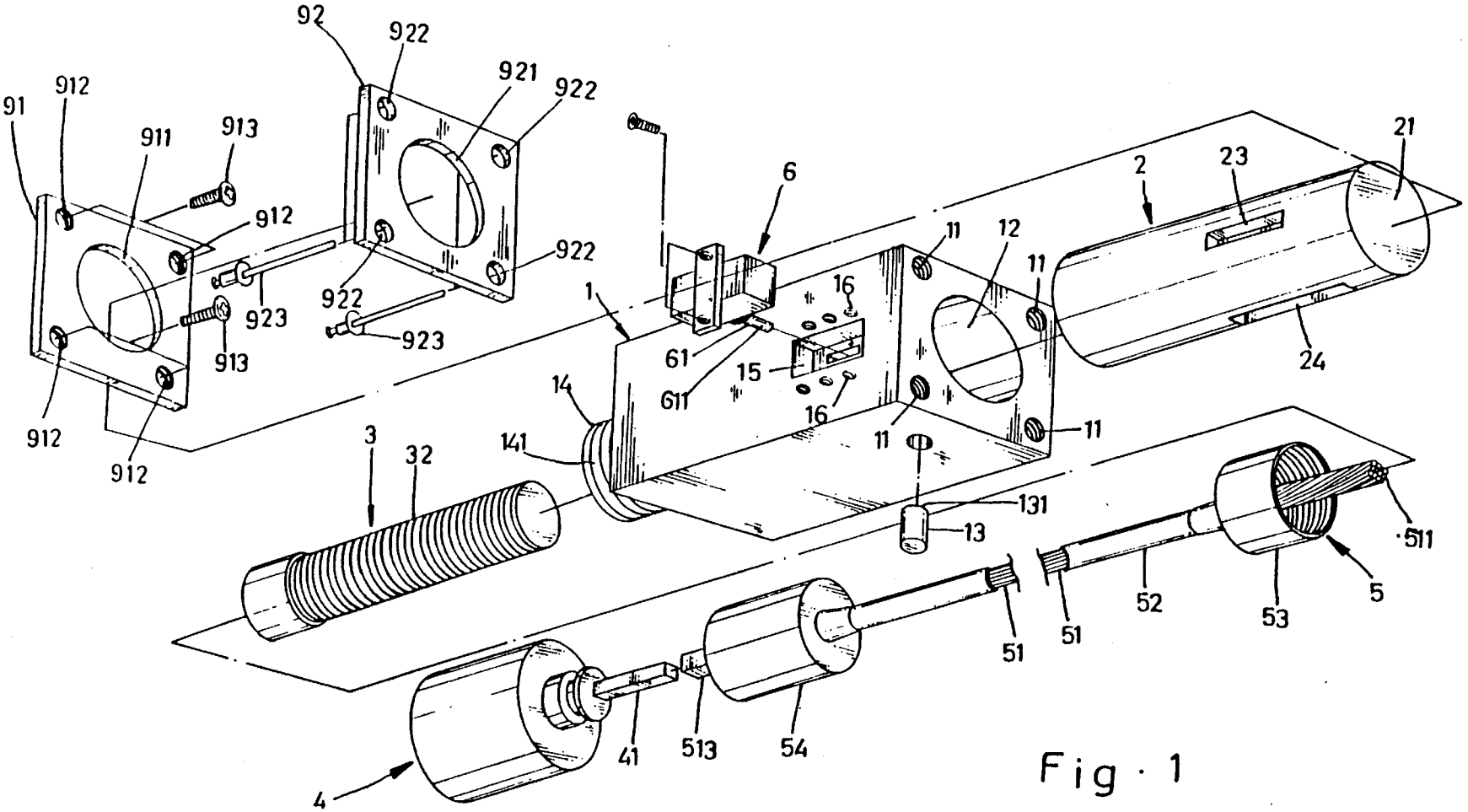
FIG. 1 is an exploded view of a lock device according to the present invention.

Referring to FIG. 1 again, there are longitudinal rows of screw holes 16 on the casing 1 by the side opening 15 for mounting the two-way switch 6 at any of a longitudinal series of positions so that the distance, in which the front end 21 of the lock bolt 2 protrudes out of the casing 1, can be adjusted subject to the structure of the motor vehicle with which the present invention is used.

Figure 7:
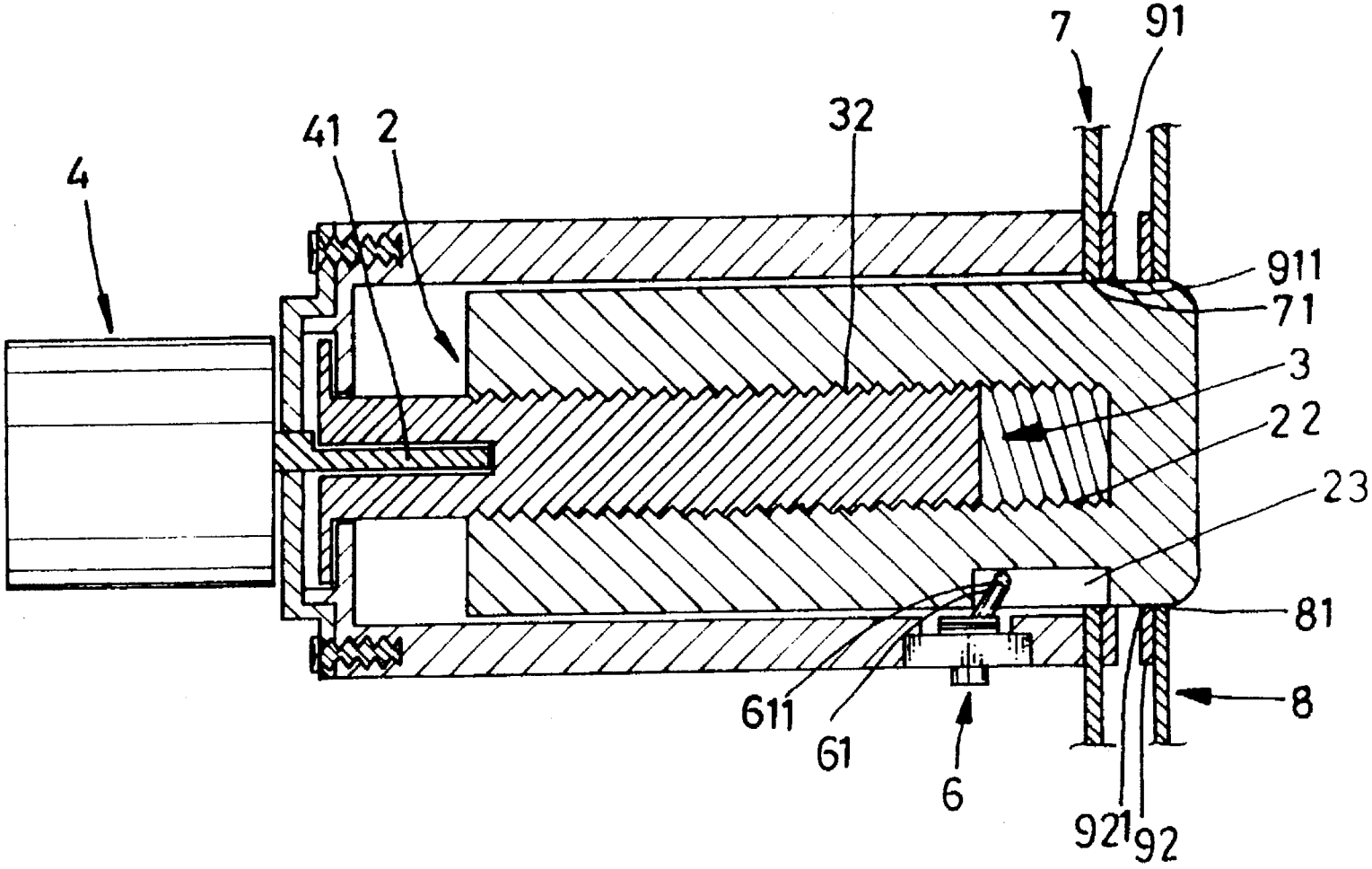
FIG. 7 is a longitudinal view in section of an alternate form of the present invention, showing the output shaft of the reversible motor directly coupled to the transmission rod.

FIG. 7 shows an alternate form of the present invention. In this alternate form, the aforesaid transmission wire assembly 5 is eliminated, the output shaft 41 of the reversible motor 4 is directly coupled to the transmission rod

We claim:

1. A remote-controlled lock device comprising:

a striking plate fixedly secured to a fixed part of a motor vehicle, said striking plate comprising a locking hole, and a plurality of mounting holes respectively fastened to said fixed part of said motor vehicle by rivets;

a mounting plate fixedly secured to a movable part of said motor vehicle for permitting said movable part to be locked in a closed position closed on said fixed part of said motor vehicle, said mounting plate comprising a center hole aligned with a hole on said movable part of said motor vehicle and the locking hole on said striking plate, a plurality of screw holes respectively aligned with respective through holes on said movable part of said motor vehicle;

a casing fixedly secured to said mounting plate, said casing comprising a plurality of longitudinal screw holes respectively connected to the screw holes on said mounting plate and the through holes on said movable part of said motor vehicle, a longitudinal center hole aligned with the center hole on said mounting plate, a locating pin at a bottom side thereof projecting into the longitudinal center hole of said casing, an externally threaded coupling tube at one end, and a side opening;

a lock bolt disposed in the longitudinal center hole of said casing, said lock bolt having a longitudinal screw hole at one end, a longitudinal locating slot and a longitudinal sliding slot on the periphery, said longitudinal sliding slot receiving said locating pin;

a reversible motor mounted inside said motor vehicle and having an output shaft;

a transmission rod having a screw rod section at one end threaded into the longitudinal screw hole on said lock bolt and a coupling hole at an opposite end coupled to the output shaft of said reversible motor;

a remote controller;

control circuit connected to said reversible motor and controlled by said remote controller to turn said reversible motor forwards and backwards; and a two-way switch mounted in the side opening on said casing and connected between said control circuit and said reversible motor, said two-way switch having a control lever inserted into the longitudinal locating slot on said lock bolt;

wherein when said reversible motor is turned in one direction by means of the control of said remote controller, said transmission rod is turned in the same direction, causing said lock bolt to be driven into the center hole on said mounting plate, the corresponding hole on said movable part of said motor vehicle, the locking hole on said striking plate, and a corresponding hole on said fixed part of said motor vehicle to lock said movable part of said motor vehicle in the closed position closed on said fixed part of said motor vehicle, and at the same time the control lever of said two-way switch is driven by said lock bolt to cut off power supply from said reversible motor; when said reversible motor is turned in the reversed direction by means of the control of said remote controller, said transmission rod is turned in the same direction, causing said lock bolt to be moved away from said fixed part of said motor vehicle, said striking plate, said movable part of said motor vehicle, and said mounting plate and received back inside said casing to unlock said movable part of said motor vehicle from said fixed part of said motor vehicle, and at the same time the control lever of said two-way switch is driven by said lock bolt to cut off power supply from said reversible motor.

2. The remote-controlled lock device of claim 1 wherein said casing further comprises two longitudinal rows of screw holes bilaterally disposed by the side opening on said casing for mounting said two-way switch at any of a longitudinal series of positions.

3. The remote-controlled lock device of claim 1 further comprising a transmission wire assembly connected between said transmission rod and said reversible motor, said transmission wire assembly comprising a flexible tube, a first screw cap fixedly connected to said flexible tube at one end and threaded onto said externally threaded coupling tube of said casing, a second screw cap fixedly connected to said flexible tube at an opposite end and coupled to said reversible motor, and a transmission wire inserted through said flexible tube and having one end fitted into the coupling hole on said transmission rod and an opposite end coupled to the output shaft of said motor by a connector.

* * * * *